US011109673B2

(12) United States Patent
Fierro et al.

(10) Patent No.: US 11,109,673 B2
(45) Date of Patent: Sep. 7, 2021

(54) DESK WITH INTEGRATED LIGHT SOURCE

(71) Applicants: Nicola Fierro, Salerno (IT); Angelo Fierro, Salerno (IT)

(72) Inventors: Nicola Fierro, Salerno (IT); Angelo Fierro, Salerno (IT)

( * ) Notice: Subject to any disclaimer, the term of this patent is extended or adjusted under 35 U.S.C. 154(b) by 6 days.

(21) Appl. No.: 16/618,383

(22) PCT Filed: May 24, 2018

(86) PCT No.: PCT/IB2018/053686

§ 371 (c)(1),
(2) Date: Dec. 1, 2019

(87) PCT Pub. No.: WO2018/220484

PCT Pub. Date: Dec. 6, 2018

(65) Prior Publication Data

US 2020/0323338 A1 Oct. 15, 2020

(30) Foreign Application Priority Data

Jun. 1, 2017 (IT) ..... 102017000060316
Mar. 21, 2018 (IT) ..... 102018000003846

(51) Int. Cl.
*A47B 13/08* (2006.01)
*A47B 97/00* (2006.01)
(Continued)

(52) U.S. Cl.
CPC ..... *A47B 13/081* (2013.01); *A47B 97/00* (2013.01); *F21S 9/02* (2013.01); *F21V 21/15* (2013.01);
(Continued)

(58) Field of Classification Search
CPC . A47B 2220/0077; A47B 13/12; A47B 13/16; A47B 13/081; F21V 33/0012
(Continued)

(56) References Cited

U.S. PATENT DOCUMENTS 1,963,477 A * 6/1934 Stein ..... F21V 21/08 362/396
2,131,708 A * 9/1938 Lesperance ..... A47B 27/00 108/23
(Continued)

FOREIGN PATENT DOCUMENTS

DE 102015113427 A1 * 2/2017 ..... E05D 13/00
DE 202017102891 U1 * 6/2017 ..... F21S 4/24
(Continued)

*Primary Examiner* — Jose V Chen
(74) *Attorney, Agent, or Firm* — Mark M. Friedman

(57) ABSTRACT

A desk with integrated light source comprises a worktop (2) having a top working surface (4) and a perimetral edge (5), lighting means (8) of the top working surface (4) comprising at least one adjustable arm (9) having a first end (11) associated with the perimetral edge (5) to move from a lowered rested position wherein it is parallel to the worktop (2) to an operative position raised with respect of the worktop (2) and a second end (12) provided with a light source (10) suitable for directing a light beam towards the top working surface (4) when the adjustable arm (9) is in the raised position, wherein the at least one adjustable arm (9) is adapted to be brought into a plurality of raised operative positions to vary the direction of origin of the light beam emitted by the light source (10).

9 Claims, 3 Drawing Sheets

(51) Int. Cl.
*F21S 9/02* (2006.01)
*F21V 21/15* (2006.01)
*F21V 33/00* (2006.01)

(52) U.S. Cl.
CPC .. *F21V 33/0012* (2013.01); *A47B 2200/0001* (2013.01); *A47B 2200/004* (2013.01); *A47B 2220/0077* (2013.01)

(58) Field of Classification Search
USPC ..... 108/23
See application file for complete search history.

(56) References Cited

U.S. PATENT DOCUMENTS 3,420,608 A * 1/1969 Canale ..... G03B 27/20 355/91
4,751,620 A * 6/1988 Wright ..... B43L 3/001 108/23
5,116,011 A * 5/1992 Smith ..... A47B 21/03 108/23
5,899,146 A * 5/1999 Kun ..... G02B 27/024 108/23
5,918,932 A * 7/1999 Morrison ..... A47B 97/00 108/23
7,398,572 B2 * 7/2008 Braun ..... A47G 9/1045 108/23
10,401,018 B1 * 9/2019 Smith ..... F21V 23/0471
10,702,078 B1 * 7/2020 Walker ..... G09F 3/208
2009/0050028 A1 * 2/2009 Liao Fang ..... A47B 13/12 108/26
2009/0265050 A1 * 10/2009 Burpee ..... A47B 23/002 701/16
2011/0242827 A1 * 10/2011 Farinola ..... A47F 5/00 362/368
2015/0182038 A1 * 7/2015 Wiemer ..... A47F 3/001 108/23
2015/0300627 A1 * 10/2015 Wang ..... F21S 9/02 108/23
2017/0284618 A1 * 10/2017 Reynolds ..... F21S 6/003
2018/0149351 A1 * 5/2018 Wallace ..... A47B 95/02
2018/0231235 A1 * 8/2018 Reynolds ..... F21V 23/005
2018/0289148 A1 * 10/2018 Maynes ..... A47B 27/02
2019/0260171 A1 * 8/2019 Bombara ..... H01R 33/88
2019/0309938 A1 * 10/2019 Towfigh ..... F21V 33/0012
2019/0376655 A1 * 12/2019 Sburlan ..... A47G 23/0266
2020/0244313 A1 * 7/2020 Visconti ..... H02J 3/00

FOREIGN PATENT DOCUMENTS

KR 100817784 B1 * 3/2008 ..... F21V 33/0012
WO WO-2018009962 A1 * 1/2018 ..... A47B 96/021

* cited by examiner

DESK WITH INTEGRATED LIGHT SOURCE

TECHNICAL FIELD

The present invention finds application in the furniture sector and has particularly for object a desk provided with one or more integrated light sources.

STATE OF THE ART

As known, the desks commonly used in studios or even in homes are typically constituted by a work surface supported by one or more feet or other supports and which the various objects from time to time necessary for the specification tasks to be done are positioned on.

Typically, in order to facilitate reading or in any case improve the visibility of what is placed on the support plane, a lamp is also provided, whose light beam being is oriented towards the same supporting plane.

However, the lamps, which usually constitute a self-standing element with respect to the desk, are considerably cumbersome, both because they reduce the space available, and because of the presence of the electrical connecting wires that do not always allow it to be placed in the more suitable position and which can also constitute an obstacle for the user.

CN104824974 describes a desk equipped with an integrated lamp in which the lamp is associated with a rotatable arm pivoted on an edge of the desk so that in a closed position the arm is arranged horizontally on the front side of the desk, so as to occlude a front opening which acts as access to a drawer inside the desk.

Although this solution partly solves the aforementioned problems, it does not appear to be completely satisfactory due to the position of the lamp and in particular to the fact that the arm can only be brought into two positions, while the adjustment of the light beam is obtained by rotating the lamp.

SCOPE OF THE INVENTION

The object of the present invention is to overcome the aforementioned drawbacks by providing a desk with an integrated light source which has features of high efficiency and relative cost-effectiveness.

A particular object is to realize a desk with integrated light source that eliminates the encumbrance typical of the lamps placed on the worktops of the desks.

Another object is to provide a desk with an integrated light source wherein the direction of the light beam or of the light beams can be adjusted in an optimal manner so as to always have the best possible illumination of the worktop.

These objects, as well as others which will appear clearer later, are achieved by a desk with an integrated light source which, according to claim 1, comprises a worktop having a top working surface and a perimetric edge, lighting means of said top working surface comprising at least one adjustable arm having a first end associated with said perimetric edge to pass from a rested lowered position wherein it is parallel to said worktop to an operative position raised relative to said worktop and a second end provided with a light source suitable for directing a light beam towards said top working surface when said adjustable arm is in said raised position, wherein said at least one adjustable arm is adapted to be brought into a plurality of operative positions raised to vary the direction of the light beam emitted by said light source.

Thanks to this combination of features, the arm may always be brought into the optimal lighting position so as to always guarantee the best lighting of the worktop. Advantageous embodiments of the invention are obtained according to the dependent claims.

BRIEF DISCLOSURE OF THE DRAWINGS

Further features and advantages of the invention will become clearer in the light of the detailed description of a preferred but not exclusive configuration of the desk according to the present invention, illustrated as a non-limiting example with the aid of the accompanying drawings wherein.

BEST MODE OF CARRYING OUT THE INVENTION

The attached figures show a preferred but not exclusive embodiment of the desk according to the invention, whose aesthetic configuration is merely exemplary and not limitative of the present invention, being able to assume any shape without particular limitations.

Figure 1:
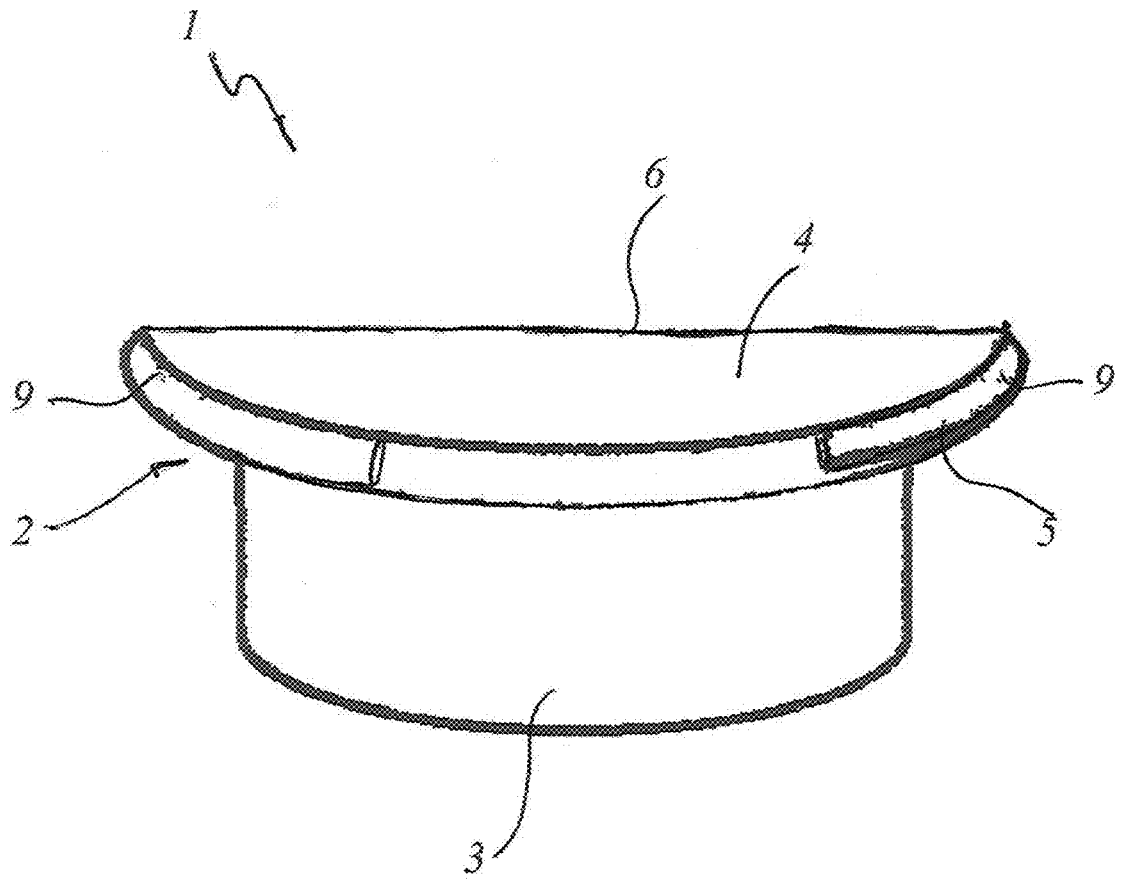
FIG. 1 is a perspective front view of the desk with the lamps in resting position.

FIG. 1 shows a particular embodiment of the desk, generally indicated by 1, provided with a worktop 2 of a semispherical shape supported by a supporting structure 3 and having a top flat working surface 4 delimited at the rear by a curved perimeter edge 5 and frontally from a straight front edge 6 which may allow access to a drawer or compartment 7.

Figure 2:
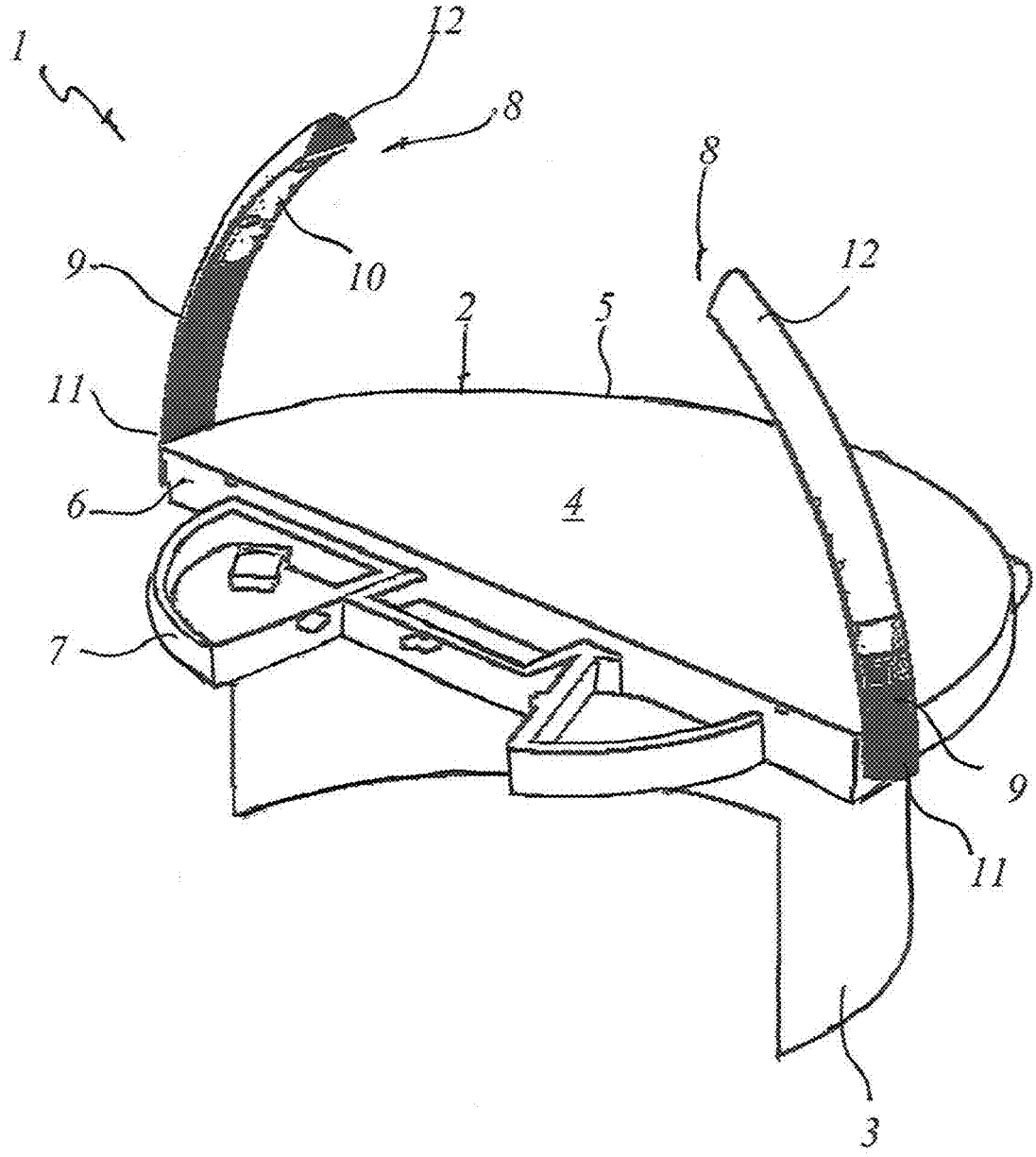
FIG. 2 is a perspective view of the desk with the lamps in an operative position.

The worktop 2 is associated with lighting means 8 of the top working surface 4 which comprise a pair of adjustable arms 9 provided with respective light sources 10. In particular, each adjustable arm 9 has a curved profile complementarily shaped with respect to a portion of the perimetral edge 5 and has a first end 11 pivoted on the perimetral edge 5 to move, following its rotation around the first end 11, between the lowered resting position of FIG. 1, wherein it is parallel to the worktop 2, and the operative position of FIG. 2 raised with respect to the worktop 2.

The second end 12 of each adjustable arm 9 is instead provided with one or more light sources 10 for directing the light beam towards the top working surface 4 when the respective adjustable arm 9 is in the raised position.

The light sources 10 may be selected from those commonly available on the market and may be of any type, either incandescent or LED or gas and may extend along the respective arm 9 according to any angular width.

The technical features of the light sources 10 do not represent a limiting aspect of the present invention, so that they will not be described in more detail.

However, according to a particularly advantageous embodiment, each light source 10 may be formed by a plurality of light spots, preferably of the LED type, operating simultaneously so as to emit respective light beams that reach the plane simultaneously from different positions, illuminating the plane in a complete and particularly efficient manner both for right-handed and left-handed people and eliminating any shade.

The profile of each adjustable arm 9 is such that it is flush with the top working surface 4 in the lowered position, so as not to produce any encumbrance with respect to the plane defined by the working surface 4.

Moreover, the profile of the adjustable arms 9 will be such as to follow the course of a respective portion of the perimetral edge 5 to keep the light sources 10 invisible when in a lowered position, so as to constitute themselves a part of the perimeter of the worktop 2 and confer particular and innovative aesthetic value to the desk 1.

Preferably, the first end 11 of the arms 9 will be pivoted on the perimetral edge 5 close to the front edge 6 to move between the lowered position and the raised position following its rotation around the first end 11 and to keep the front edge 6 always accessible both in the lowered position than in the raised position.

In this way the possible drawer or compartment 7 accessible from the front edge 6 will always be free and reachable both when the arms 9 are in the lowered position and in the raised position.

Furthermore, the adjustable arms 9 will never reduce the available work surface as they will always be fixed outside the same.

According to a peculiar feature of the invention, the arms 9 are adapted to be brought into a plurality of operative raised positions to vary the direction of origin of the light beam emitted by the respective light sources 10.

The adjustment of the position of the arms 9 may be either continuous, i.e. with the arms 9 which can be locked in any angular position, or of a discontinuous type, wherein the arms 9 can only be locked in certain angular positions.

In the illustrated embodiment the two arms 9 are hinged on the perimetral edge 5 in a symmetrical position with respect to a median plane of vertical symmetry of the worktop 2.

However, according to a not shown variant, the lighting means 8 may also comprise a single arm or more than two arms.

According to yet another variant, not shown, the arm or the arms may be incorporated in the worktop 2 and come out from the inside thereof with a perpendicular translation movement so that in the lowered position the light sources 10 are invisible.

In this case the arms 9 may always be arranged outside the work surface 4 so that in the raised position they do not constitute any encumbrance.

In a particular variant, the arms 9 may have a telescopic structure.

The movement of the arms 9 may be performed manually or by motor means associated with the arms and adapted to promote the controlled passage between the respective lowered and raised positions, independently or synchronized with each other.

Figure 3:
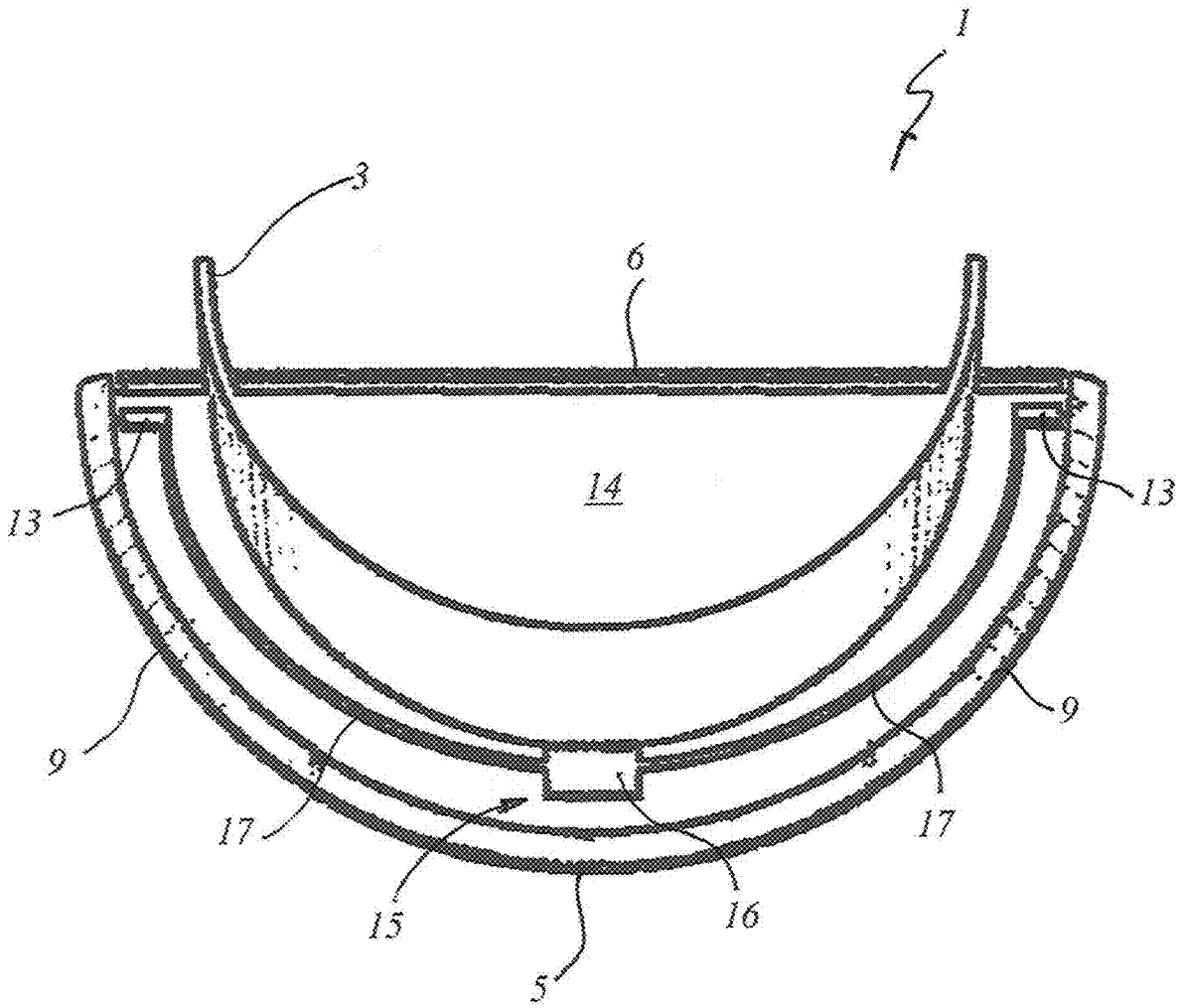
FIG. 3 is a lower view of the desk with the lamps in resting position.

From FIG. 3 it can be observed that the motor means comprise for each adjustable arm 9 a respective electric motor 13 located on the lower face 14 of the worktop 2, so as to be not visible, and adapted to operate on the corresponding first hinged end 11. The lighting means 8 also comprise electric power means 15 of the light sources 10. According to the embodiment of the figures, the electric power means 15 comprise an electric battery 16 or accumulator arranged on the lower face 14 of the worktop 2, so as to be hidden from view, and connected through electrical cables 17 to the light sources 10 and to the electric motors 13.

By this way, the battery 16 will power both the light sources 10 and the electric motors 13, through separate commands or through a single control which will drive the motors 13 and simultaneously turn on the light sources 10.

According to an alternative embodiment, not shown, the electric power means 15 may comprise a cable for connection to an electric network which will connect to the light sources 10 always so as not to constitute a bulk for the user.

The switching on and off of the light sources 10 may be managed by appropriate switches associated to the same sources 10 or to the battery 16 or to the power cable, or they may be obtained automatically upon the raising and lowering of the arms 9.

By way of example, the arms 9 may be provided, at the respective first ends 11, with movable sliding contacts adapted to interact with respective fixed sliding contacts associated with the perimetral edge 5 and connected to the electric power means 15.

The interaction between the movable sliding contacts and the fixed ones will occur only after the passage of the adjustable arms 9 from the lowered position to any raised position in order to have the automatic lighting of the light sources 10.

On the contrary, the return of the arms 9 to the resting position will cause the decoupling between the contacts and the consequent interruption of the power 15.

Also in this case a general switch may be provided which will interrupt the power, making it impossible to switch on the light sources 10 even with the arms 9 in one of the raised positions.

The materials that can be used for the desk and the arms, as well as for the light sources, can be selected among those commonly used in the field, without particular limitations.

The desk according to the invention is susceptible of numerous modifications and variations, all of which are within the inventive concept expressed in the appended claims. All the details may be replaced by other technically equivalent elements, and the materials and tools may be different according to requirements, without departing from the scope of protection of the present invention.

Although the desk has been described with particular reference to the attached figures, the reference numbers used in the description and claims are used to improve the intelligence of the invention and do not constitute any limitation to the claimed scope of protection.

The invention claimed is:

1. A desk with integrated light source, comprising:

a worktop (2) having a top working surface (4) and a perimetral edge (5);

at least one adjustable arm (9) having a first end (11) pivoted on said perimetral edge (5) to move by means of its rotation about said first end (11) from a lowered rested position wherein it is parallel to said worktop (2) to an operative position raised with respect of said worktop (2) and a second end (12) provided with a light source (10) suitable for directing a light beam towards said top working surface (4) when said adjustable arm (9) is in said raised position;

wherein said at least one adjustable arm (9) is adapted to be brought into a plurality of raised operative positions to vary the direction of origin of the light beam emitted by said light source (10);

wherein two adjustable arms (9) are provided with respective light sources (10) and hinged on said perimetral edge (5) in symmetrical positions with respect to a middle vertical plane of symmetry of said worktop (2).

2. Desk as claimed in claim 1, characterized in that said at least one adjustable arm (9) is designed to be flush with said top working surface (4) when it is in said lowered position.

3. Desk as claimed in claim 1, characterized in that said at least one adjustable arm (9) is complementarily shaped with respect to a portion of said perimetral edge (5).

4. Desk as claimed in claim 3, characterized in that said perimetral edge (5) comprises a front edge (6) provided with an opening for access to a drawer or compartment (7) and at least one side edge, said at least one adjustable arm (9) being hinged at said first end (11) to said side edge to keep said front edge (6) always accessible both in said lowered position and in any of said raised positions.

5. Desk as claimed in claim 1, characterized in that said light sources (10) comprise a plurality of light spots suitable for emitting respective light beams to illuminate said top working surface (4) substantially in a complete manner.

6. Desk as claimed in claim 1, characterized in that the desk comprises a motor unit (13) associated with said adjustable arms (9) to promote the controlled passage thereof between the respective lowered and raised positions, in a manner independent or synchronized with each other.

7. Desk as claimed in claim 6, characterized in that said motor unit comprises for each of said adjustable arms (9) an electric motor arranged at the lower face (14) of said worktop (2).

8. Desk as claimed in claim 1, characterized in that it comprises an electric power unit (15) of said one or more light sources (10).

9. Desk as claimed in claim 8, characterized in that said electrical power unit (15) comprises one or more batteries or accumulators (16) arranged on the lower face (14) of said worktop (2), and/or a cable (17) for connection to an electrical network.

* * * * *